US005568778A

United States Patent [19]

Sahl

[11] Patent Number: 5,568,778

[45] Date of Patent: Oct. 29, 1996

[54] APPARATUS FOR FEEDING A WORKPIECE INCLUDING A ROTOR AND ENDLESS BELTS

[76] Inventor: Johannes Sahl, Tannenweg 17, A-4501 Neuhofen a.d. Krems, Austria

[21] Appl. No.: 371,032

[22] Filed: Jan. 10, 1995

[30] Foreign Application Priority Data

Jan. 19, 1994 [AT] Austria ..... A 88/94

[51] Int. Cl.[6] ..... D05B 27/10

[52] U.S. Cl. ..... 112/306; 112/322

[58] Field of Search ..... 112/306, 318, 112/322, 304, 317, 320, 153, 63

[56] References Cited

U.S. PATENT DOCUMENTS

| | | | |
|---|---|---|---|
| 2,378,731 | 6/1945 | Seaman | 112/322 |
| 3,994,247 | 11/1976 | Cummins | 112/153 X |
| 4,883,005 | 11/1989 | Wehmeyer | 112/306 X |
| 5,370,072 | 12/1994 | Adamski, Jr. | 112/306 X |

FOREIGN PATENT DOCUMENTS

| | | | |
|---|---|---|---|
| 0 383 045 | 8/1990 | European Pat. Off. . | |
| 2826084 | 1/1979 | Germany | 112/318 |
| 2249686 | 10/1987 | Japan | 112/63 |
| 650 293 | 7/1985 | Switzerland . | |

*Primary Examiner*—Ismael Izaguirre
*Attorney, Agent, or Firm*—Collard & Roe, P.C.

[57] ABSTRACT

An apparatus for feeding a workpiece in a machine tool, particularly in a sewing machine, comprises a main conveyor for longitudinally conveying the workpiece in a feeding direction and an auxiliary conveyor for transversely conveying the workpiece to align the same, which auxiliary conveyor comprises a conveying mechanism, which precedes or succeeds the main conveyor and is engageable with the workpiece as it is guided along a guideway and comprises conveying elements which are adapted to be driven to move transversely to the feeding direction. To ensure exact, simple and functionally reliable feeding, the conveying mechanism of the auxiliary conveyor is incorporated in a generally cylindrical rotor, which is rotatable about an axis of rotation, which is normal to the feeding direction and parallel to the direction of the guideway and is adapted to be driven at a surface speed which is related to the speed of travel of the main conveyor, the conveying elements of the auxiliary conveyor consists of a plurality of conveyor belts, which are regularly distributed about the axis of rotation of the rotor and are adapted to be driven by an adjusting drive independently of the rotation of the rotor.

8 Claims, 4 Drawing Sheets

APPARATUS FOR FEEDING A WORKPIECE INCLUDING A ROTOR AND ENDLESS BELTS

BACKGROUND OF THE INVENTION

1. Field of the Invention

This invention relates to an apparatus for feeding a workpiece in a machine tool, particularly in a sewing machine, comprising a main conveyor for longitudinally conveying the workpiece in a feeding direction and an auxiliary conveyor for transversely conveying the workpiece to align the same, which auxiliary conveyor comprises a conveying mechanism, which precedes or succeeds the main conveyor and is engageable with the workpiece as it is guided along a guideway and comprises conveying elements which are adapted to be driven to move transversely to the feeding direction.

2. Description of the Prior Art

It should be possible to feed a workpiece to be processed not only along a straight path but also along an arcuate path and to advance the workpiece in a direction which is parallel to an edge or hem. It is known to accomplish this in that machine tools, particularly sewing machines, are provided with a feeding apparatus, which is composed of a main conveyor and an auxiliary conveyor. The main conveyor moves the workpiece along a straight line in the feeding direction and the auxiliary conveyors imparts to the workpiece in case of need a transverse movement, which is normal to the feeding direction, so that the workpiece can be fed along a straight or an arcuate path or in a direction which is parallel to an edge in dependence on whether or not tile auxiliary conveyor is operated and on its direction of conveyance. As is apparent from EP-B 0 383 045 it is known to provide such apparatuses with auxiliary conveyors which comprise a conveying mechanism which is engageable with the workpiece and comprises a conveyor chain, which revolves transversely to the feeding direction and carries rotatable rolling elements. When the conveyor chain engages the workpiece said rolling elements can roll on the workpiece in the feeding direction and thus enable a feeding of the workpiece along a straight line. When the conveyor chain is being driven the rolling elements constitute coupling means acting on the workpiece to move it transversely to the feeding direction. But in that case there are only point contacts between the rolling elements and the workpiece and the transverse movement of the rolling elements must be superposed on the rolling movement in the feeding direction. The latter fact often gives rise to difficulties in the transverse conveyance of the workpiece to align the same. Such difficulties are particularly undesirable in the feeding of workpieces soft, compressible workpieces, such as textile products. Besides, the rolling elements must be non-displaceably mounted on the chain but must freely be rotatable. These requirements give rise to a high structural expenditure and high maintenance expenditure.

CH-A-650,293 discloses tentering means for use in sewing machines for processing tubular workpieces. Said tentering means comprise two rotatable tentering members for tentering the workpiece and aligning means, which are associated with the tentering members and serve for the proper alignment of the edges of the workpiece for the sewing operation. The aligning means are inserted in the tentering members or in separate roll-like bearing members. The aligning means consist of gears, which extend in planes which are axial with respect to the axes of rotation of the tentering members or bearing members. Said gears are adapted to be driven by a worm gear independently of the associated tentering or bearing member so that the workpiece which has been fitted on the tentering members can be aligned even during a rotation of the tentering member in that the workpiece is displaced in the axial direction of the tentering members by said gears. But in that case there is also only a point contact between the workpiece and the aligning member and the aligning members cannot engage and guide the workpiece directly at its edges so that such aligning means cannot effectively be used to align two-dimensional workpieces by a transverse conveyance.

SUMMARY OF THE INVENTION

For this reason it is an object of the invention to eliminate said disadvantages and to provide a feeding apparatus which is of the kind described first hereinbefore and distinguishes by having a relatively simple and sturdy structure and by having a particularly high reliability in operation.

That object is accomplished in accordance with the invention in that the conveying mechanism of the auxiliary conveyor is incorporated in a generally cylindrical rotor, which is rotatable about an axis of rotation, which is normal to the feeding direction and parallel to the direction of the guideway and is adapted to be driven at a surface speed which is related to the speed of travel of the main conveyor, the conveying elements of the auxiliary conveyor consist of a plurality of conveyor belts, which are regularly distributed about the axis of rotation of the rotor and are adapted to be driven by an adjusting drive independently of the rotation of the rotor, and the radially outer courses of the conveyor belts constitute parts of the peripheral surface of the rotor. Revolving in contact with the workpiece, the rotor may assist the movement imparted to the workpiece by the main conveyor in the feeding direction, and the rotor will cause the conveying mechanism of the auxiliary conveyor to roll on the workpiece so that when said conveying mechanism engages the workpiece the conveying mechanism then will not move relative to the workpiece in the feeding direction. For this reason said conveying mechanism is operable to impart a transverse movement to the workpiece without such a relative movement in the feeding direction so that a satisfactory transverse conveyance of the workpiece will be ensured and the workpiece can exactly be aligned as desired. Owing to the distinct separation between the movements in the longitudinal and transverse directions the workpiece can exactly be guided as desired as it is processed and the speeds of the main conveyor and the rotor of the auxiliary conveyor can properly be matched to subject the workpiece to a desired tension so that the feeding of textiles or other flexible workpieces can substantially be improved. The conveying elements of the conveying mechanism of the auxiliary conveyor consist of conveyor belts because in that case the conveying mechanism will have a relatively simple and sturdy structure, which is not susceptible to malfunction and has only low maintenance requirements and in particular, there will be a surface contact between the radially outer conveying courses of said conveyor chains and the workpiece. That surface contact will ensure a satisfactory transverse conveyance of the workpiece without any problems even if the workpieces are flexible or bendable. As a result, the workpiece can be forced to perform a transverse movement which is relatively large relative to its longitudinal movement and because the conveyor belts extend across the edges of each workpiece the latter will properly be guided also at its edges or hems.

Such a rotor will have a desirable design if the rotor comprises an annular cage having carrying rods, which are parallel to the axis of rotation of the rotor and are equal in number to the conveyor belts, which rods have an approximately trapezoidal cross-section and taper toward said axis of rotation and each of said rods is provided at one of its radially extending longitudinal side faces with means for movably mounting and guiding one of said conveyor belts. In that case the carrying rods and the interposed conveyor belts may be accommodated in a large number even in a rotor which is relatively small in diameter so that the overall dimensions of the auxiliary conveyor may be relatively small and said auxiliary conveyor may be used in various machine tools within a small space.

Any desired adjusting drive might be used to operate the conveying mechanism incorporated in the rotor, provided that such drive permits the conveying elements to perform the required movement during the rotation of the rotor. But a particularly desirable drive will be obtained if the adjusting drive comprises a drive screw, which coaxially protrudes into the rotor and is mounted to be rotatable relative to the rotor and is adapted to be driven by a stepping motor and cooperates with the slack radially inner courses of the conveyor belts, which preferably have a toothed profile. In that case the drive will be fairly simple and functionally reliable and all conveyor belts will be operated in synchronism by a single drive screw at the same time. When the stepping motor drives the drive screw at the same speed as the rotor, there will be no relative movement between the rotor and the conveyor belts and the workpiece will be advanced by the rotor along a straight line. On the other hand, when there is a speed difference between the drive screw and the rotor, the conveyor belts will revolve and a transverse movement will be imparted to the workpiece in a direction and at a velocity which will depend on whether the speed of the drive screw is higher or lower than that of the rotor and on the speed difference. Whereas the drive screw might cooperate also with flat conveyor belts by frictional coupling, a positive coupling of the drive screw to the conveyor belts will be ensured if the latter have a toothed profile and an exact conveying movement will be effected in that case. The toothed profile will also improve the conveying action on the workpiece.

A further feature of the invention resides in that two superposed rotors are provided, which are provided with respective conveying mechanisms, and a guide plate is adapted to be inserted between said two rotors. In that case it will be possible to feed two superposed workpieces, which are to be processed jointly, or such workpieces can be aligned with each other, so that the field of application of the feeding apparatus will greatly be enlarged. In that case each rotor is operated independently of the other and may transversely move the workpieces consisting, e.g., of plies of fabric, independently of each other so that an automatic sewing operation will be ensured.

DETAILED DESCRIPTION OF THE PREFERRED EMBODIMENTS

Figure 1:
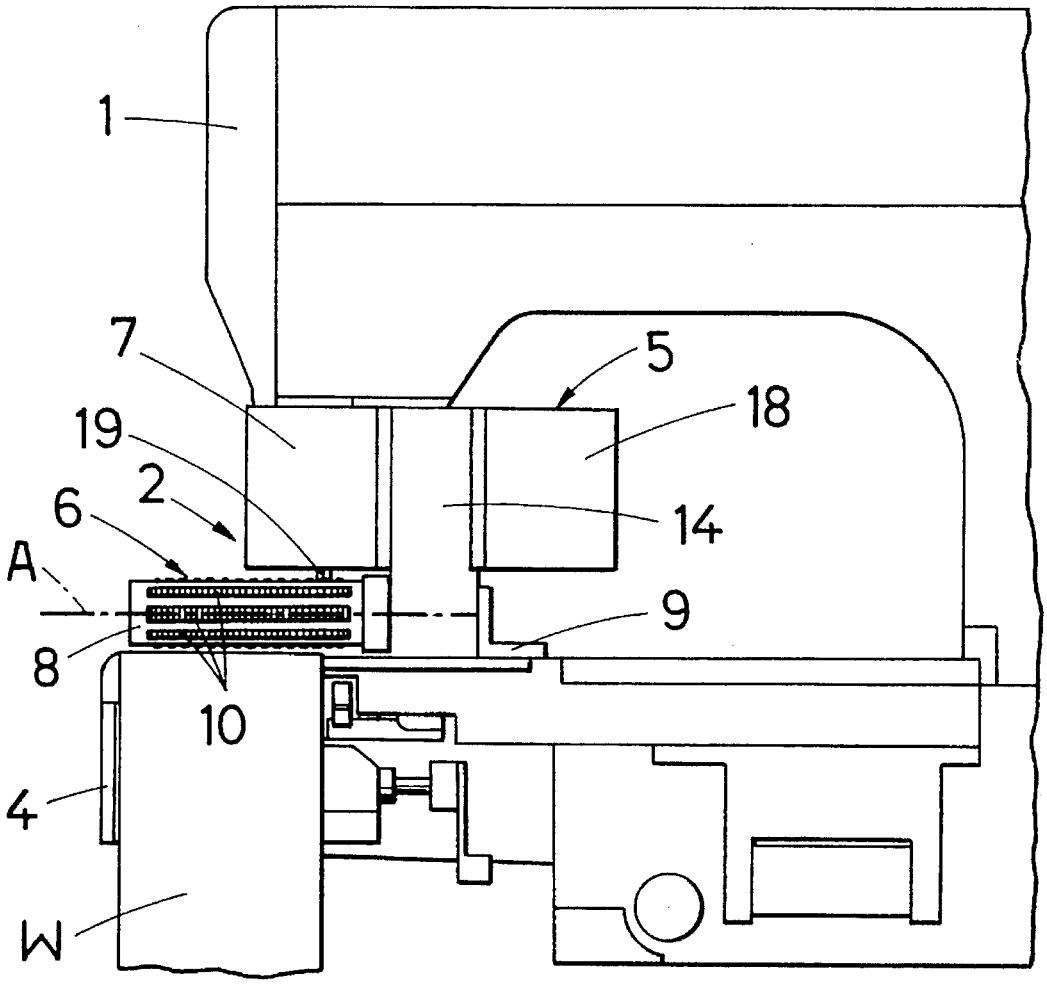
FIGS. 1 and 2 are a side elevation and an end elevation, respectively and show a sewing machine provided with a feeding apparatus in accordance with the invention.
Figure 2:
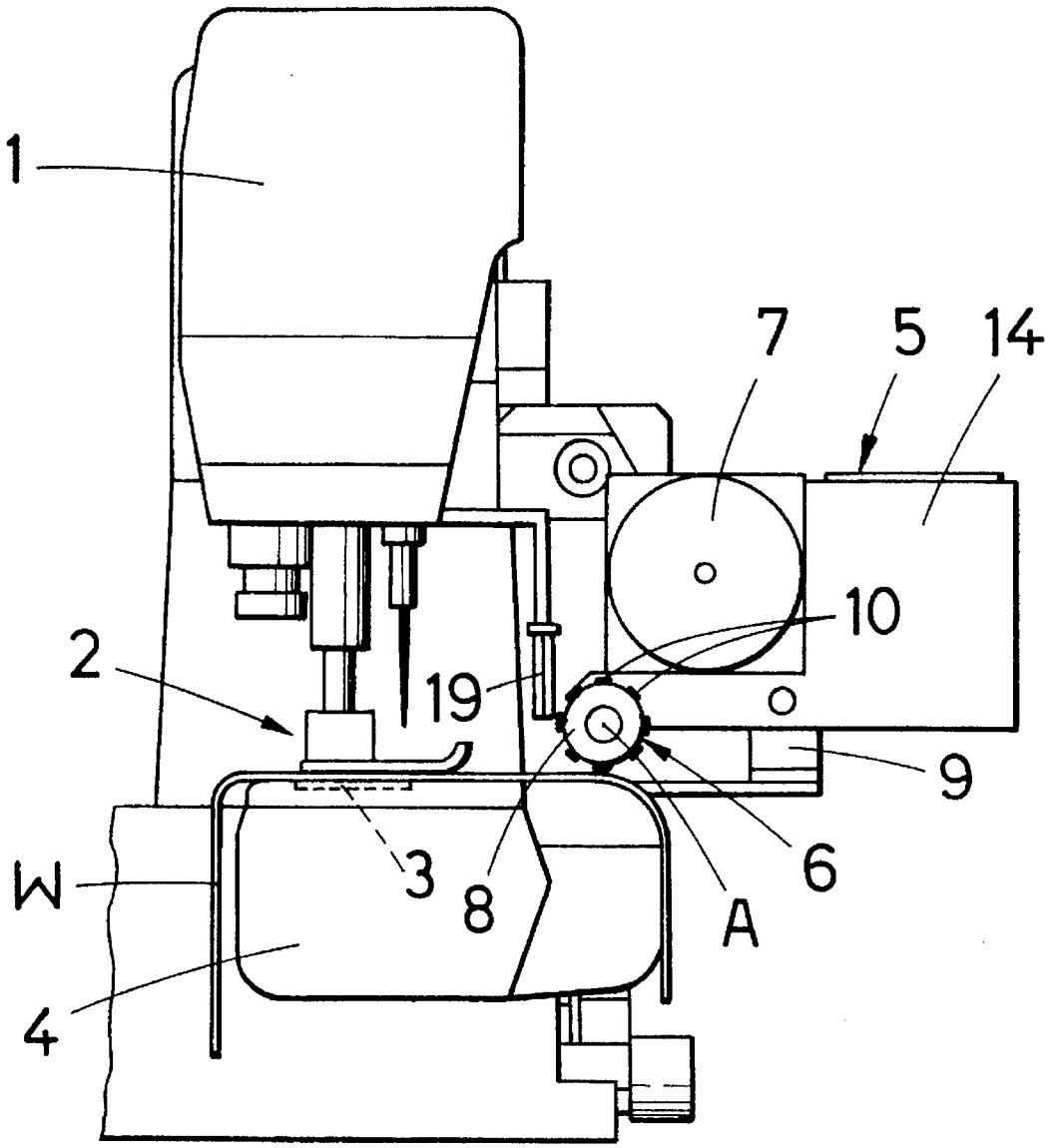

Embodiments of the invention are illustrated by way of example in the drawing.

To permit in a sewing machine 1 a fully automatic sewing along a straight line or along an arcuate line or in a direction which is parallel to an edge of the workpiece, a feeding apparatus 2 is provided, which is composed of a main conveyor 3 for longitudinally conveying the workpiece W to be processed in the feeding direction, and an auxiliary conveyor 5 for transversely conveying the workpiece W to align the same. The main conveyor 3 is built into machine table 4 of sewing machine 1. The auxiliary conveyor 5 comprises a conveying mechanism 6, which is engageable with the top surface of the workpiece W and comprises conveying elements, which are selectively engageable with the top surface of the workpiece W and are adapted to be driven to move transversely to the feeding direction. The conveying mechanism 6 is incorporated in a rotor 8, which is adapted to be driven by a stepping motor 7. The rotor 8 has an axis of rotation A, which is normal to the feeding direction and is parallel to a guideway, which is constituted only by the machine table 4. The rotor 8 and the stepping motor 7 are carried by a frame 9, which is adapted to be lifted and lowered relative to the machine table 4 so that the conveyor belts 10 can be selectively disengaged from and engaged with the top surface of the workpiece lying on the guideway which is constituted by the machine table 4. The conveying mechanism 6 comprises conveying elements consisting of conveyor belts 10, which are regularly distributed about the axis of rotation A and revolve around respective pairs of reversing pulleys 11 and have each an outer conveying course 10*a* and an inner slack course 10*b*. The conveying courses are radially spaced from each other. The outer conveying courses 10*a* constitute parts of the peripheral surface of the rotor 8. The rotor 8 comprises a cylindrical annular cage that comprises carrying rods 12, which are parallel to the axis of rotation A and have a trapezoidal cross-section that tapers toward the axis of rotation A. At one of its radially extending longitudinal side faces each carrying rod 12 carries means 13 for supporting and guiding one of the conveyor belts 10 and for rotatably mounting the two associated reversing pulleys 11 so that a plurality of such conveyor belts 10 can be accommodated in the rotor 8. An adjusting drive 14 for driving the conveyor belts 10 comprises a screw drive 15 comprising a drive screw 16, which coaxially protrudes into the rotor 8 and cooperates with the slack inner courses 10*b* of the conveyor belts 10, which have a mating tooth profile. The drive screw 16 is driven by a stepping motor 18. The rotation of the rotor 8 and the rotation of the drive screw 16 can selectively be coordinated so that the conveyor belts 10 are either stationary or move relative to the rotor 8 during a rotation of the rotor 8.

During the conventional feeding along a straight line, the conveyor belts 10 are engaged with the top surface of the workpiece W and the rotor 8 is driven at a surface speed that matches the speed of travel of the main conveyor 3. At that time the drive screw 16 rotates at the same speed as the rotor 8 so that the conveyor belts 10 do not move relative to the rotor 8 but their conveying courses 10*a* roll on the workpiece without imparting a transverse movement thereto. But when control means, not shown, are used to give an instruction to impart a transverse movement to the workpiece in dependence on a predetermined sewing program or, for a sewing along a line which is parallel to an edge of the workpiece W, under the control of sensors 19 which scan the edges of the workpiece W. The stepping motor 18 is then caused to rotate the drive screw 16 at a speed which is different from that of the rotor 8 so that the conveyor belts 10 cooperating with the drive screw 16 move in one direction or the other and impart a transverse movement to the workpiece W, which they engage at its top surface. The desired transverse movement is then imparted to the workpiece W so that the latter is aligned as desired. The transverse movement will be imparted to the workpiece W as long as the drive screw 16 and the rotor 8 are rotating at different speeds so that the feeding conditions can be varied within a wide range. As soon as the drive screw 16 is again rotated at the same speed as the rotor 8, the transverse movement imparted to the workpiece will depend on whether the speed of the drive screw 16 is higher or lower than the speed of the rotor 8.

Figure 3:
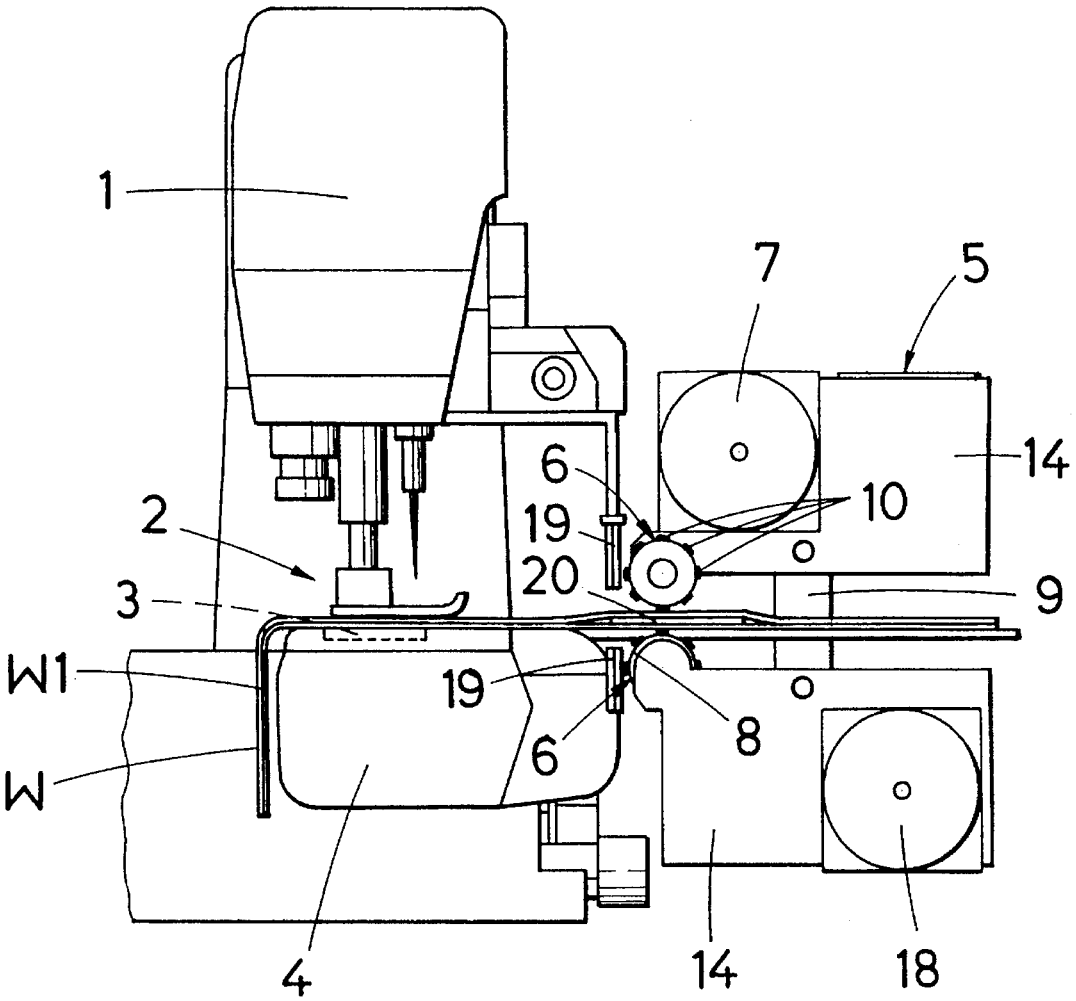
FIG. 3 is an end elevation showing the sewing machine provided with a different embodiment of a feeding apparatus in accordance with the invention.
Figure 4:
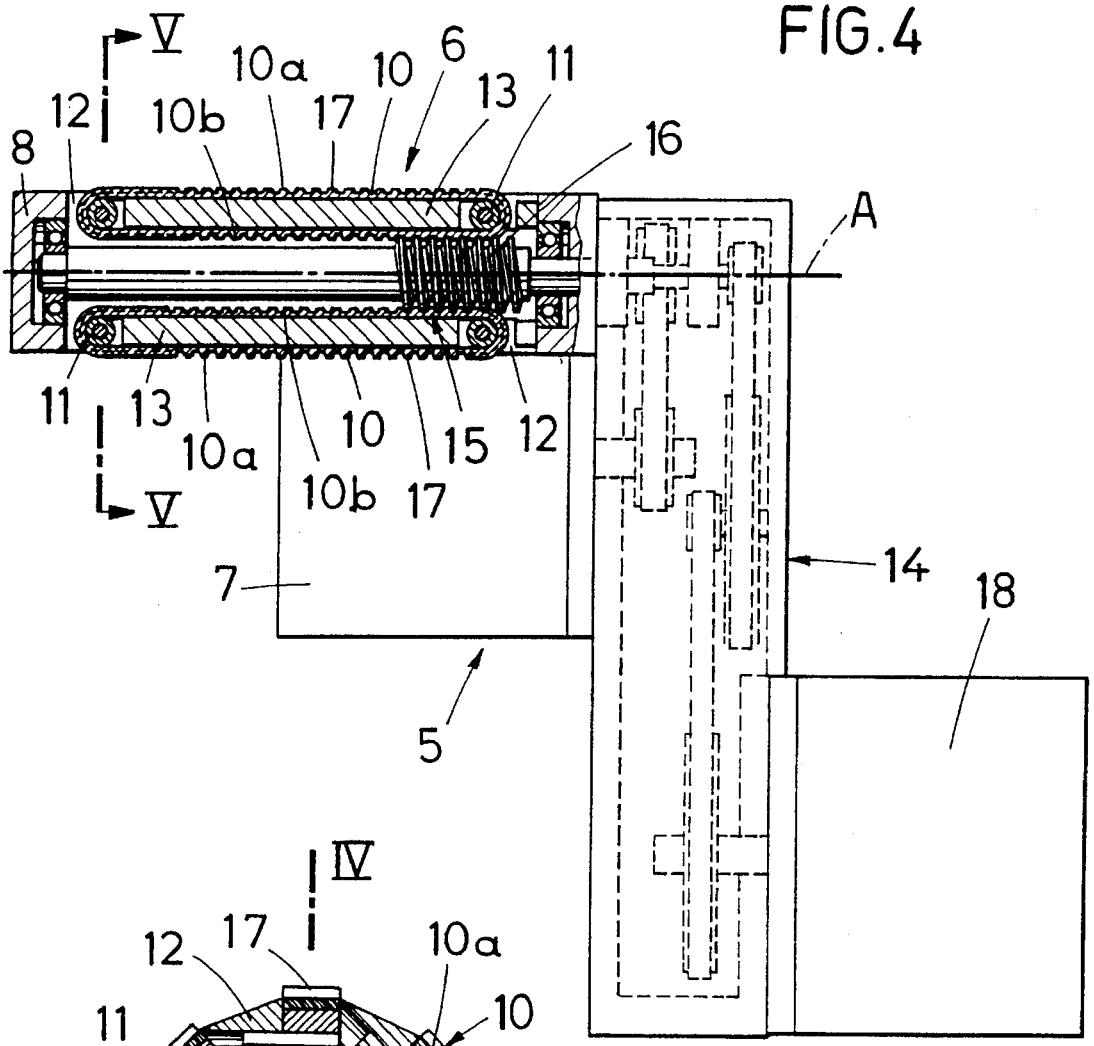
FIGS. 4 and 5 are, respectively, a top plan view, partly in section, and an enlarged transverse sectional view taken on line V—V in FIG. 4 and show a feeding apparatus in accordance with the invention.
Figure 5:
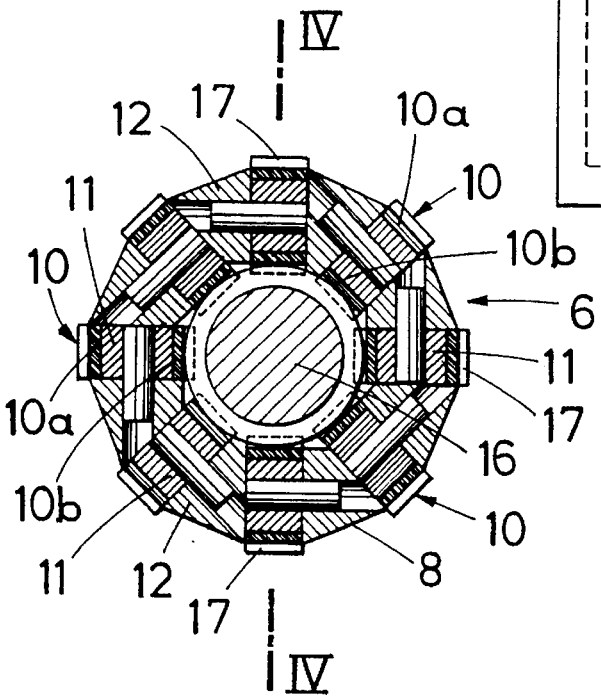

In the embodiment shown in FIG. 3 the sewing machine 1 is provided with an auxiliary conveyor 5, which comprises two superposed rotors 8, each of which incorporates a conveying mechanism 6. In that case the rotors 8 may be engaged with the top and bottom surfaces of the workpiece W and it is also possible to feed between the rotors two superposed workpieces W, W1 so that they can be sewn to each other at their edges. In that case it will be sufficient to insert a guide plate between the two rotors 8 so that each of the two fabric plies W, W1 is guided between the guide plate 20 and one of the rotors 8 and can be aligned by the associated rotor 8 and the conveying mechanism 6 incorporated therein. It will be understood that suitable driving and control means must be provided for each of the rotors 8.

I claim:

1. In an apparatus for feeding at least one workpiece in a machine tool along a guideway, comprising a main conveyor for conveying in a predetermined feeding direction a workpiece along the guideway at a controlled speed, and an auxiliary conveyor for aligning said workpiece by moving the workpiece transversely to said feeding direction while the workpiece is conveyed in said direction, which auxiliary conveyor is spaced from, and mounted independently of, said main conveyor and comprises at least one conveying mechanism, which comprises conveying elements selectively engageable with said workpiece and movable transversely to said feeding direction, and an adjusting drive for driving said conveying elements transversely to said feeding direction, the improvement of the auxiliary conveyor comprising a generally cylindrical rotor mounted for rotation about an axis of rotation which is normal to said feeding direction and parallel to said guideway, and means for rotating said rotor about said axis of rotation at a surface speed which corresponds to said controlled speed of said main conveyor, said rotor having a peripheral surface and being selectively movable to engage said peripheral surface with the workpiece conveyed along said guideway, said conveying mechanism comprising said rotor and said conveying elements consisting of a plurality of endless conveyor belts, which are regularly distributed around said axis of rotation and are adapted to revolve in the direction of said axis of rotation and have outer courses which constitute parts of said peripheral surface of said rotor, and said adjusting drive being operable to drive said conveyor belts independently of the rotation of said rotor at speeds different from said controlled speed.

2. The improvement set forth in claim 1, wherein the machine tool is a sewing machine.

3. The improvement set forth in claim 1, wherein said auxiliary conveyor precedes said main conveyor.

4. The improvement set forth in claim 1, wherein said main auxiliary conveyor succeeds said main conveyor.

5. The improvement set forth in claim 1, wherein two of said workpieces are to feel the machine tool at the same time, wherein two superposed ones of said rotors are provided and comprise respective ones of said conveying mechanisms and a guide plate for guiding said two workpieces on opposite sides of said guide plate is adapted to be inserted between said rotors.

6. In an apparatus for feeding at least one workpiece in a machine tool along a guideway, comprising a main conveyor for conveying in a predetermined feeding direction a workpiece along the guideway at a controlled speed, and an auxiliary conveyor for aligning said workpiece by moving the workpiece transversely to said feeding direction while the workpiece is conveyed in said direction, which auxiliary conveyor is spaced from, and mounted independently of, said main conveyor and comprises at least one conveying mechanism, which comprises conveying elements selectively engageable with said workpiece and movable transversely to said feeding direction, and an adjusting drive for driving said conveying elements transversely to said feeding direction, the improvement of the auxiliary conveyor comprising a generally cylindrical rotor mounted for rotation about an axis of rotation which is normal to said feeding direction and parallel to said guideway, and means for rotating said rotor about said axis of rotation at a surface speed which corresponds to said controlled speed of said main conveyor, said rotor having a peripheral surface and being selectively movable to engage said peripheral surface with the workpiece conveyed along said guideway, said conveying mechanism comprising said rotor and said conveying elements consisting of a plurality of endless conveyor belts, which are regularly distributed around said axis of rotation and are adapted to revolve in the direction of said axis of rotation and have outer courses which constitute parts of said peripheral surface of said rotor, said rotor comprising an annular cage comprising carrying rods equal in number to said conveyor belts, approximately trapezoidal in cross-section and tapering like a sector toward said axis of rotation, each of said carrying rods having a radially extending longitudinal side face, means arranged in a respective one of said endless conveyor belts for supporting and guiding said conveyor belt at said longitudinal side face of each of said carrying rods, and said adjusting drive being operable to drive said conveyor belts independently of the rotation of said rotor at speeds different from said controlled speed.

7. In an apparatus for feeding at least one workpiece in a machine tool along a guideway, comprising a main conveyor for conveying in a predetermined feeding direction a workpiece along the guideway at a controlled speed, and an auxiliary conveyor for aligning said workpiece by moving the workpiece transversely to said feeding direction while the workpiece is conveyed in said direction, which auxiliary conveyor is spaced from, and mounted independently of, said main conveyor and comprises at least one conveying mechanism, which comprises conveying elements selectively engageable with said workpiece and movable transversely to said feeding direction, and an adjusting drive for driving said conveying elements transversely to said feeding direction, the improvement of the auxiliary conveyor comprising a generally cylindrical rotor mounted for rotation about an axis of rotation which is normal to said feeding direction and parallel to said guideway, and means for rotating said rotor about said axis of rotation at a surface speed which corresponds to said controlled speed of said main conveyor, said rotor having a peripheral surface and being selectively movable to engage said peripheral surface with the workpiece conveyed along said guideway, said conveying mechanism comprising said rotor and said conveying elements consisting of a plurality of endless conveyor belts, which are regularly distributed around said axis of rotation and are adapted to revolve in the direction of said axis of rotation and have outer courses which constitute parts of said peripheral surface of said rotor, said endless conveyor belts having inner courses radially spaced from said outer courses, and said adjusting drive being operable to drive said conveyor belts independently of the rotation of said rotor at speeds different from the controlled speed, the adjusting drive comprising a drive screw protruding coaxially into said rotor, being mounted to be rotatable relative to said rotor and cooperating with said inner courses of said conveyor belts, and a stepping motor for driving said drive screw.

8. The improvement set forth in claim 7, wherein said conveyor belts have a toothed profile.

* * * * *